United States Patent [19]

Nutter

[11] 4,165,114

[45] Aug. 21, 1979

[54] TRUSS HOIST

[76] Inventor: Larry L. Nutter, 6436 Fremont Ave., Brooklyn Center, Minn. 55430

[21] Appl. No.: 887,244

[22] Filed: Mar. 16, 1978

[51] Int. Cl.[2] ..... B25J 1/00

[52] U.S. Cl. ..... 294/19 R

[58] Field of Search ..... 294/1 R, 19 R, 15, 17, 294/22–24, 26, 85, 86 R, 92; 52/122, 125, DIG. 1; 214/1 S, 1 SW; 248/351, 357, 353; 254/17, 22, 121, 131

[56] References Cited

U.S. PATENT DOCUMENTS

| | | | |
|---|---|---|---|
| 219,368 | 9/1879 | Sharer | 294/19 R |
| 607,567 | 7/1898 | Jordan | 254/17 |
| 1,665,430 | 4/1928 | Arzt | 254/17 |
| 2,428,941 | 10/1947 | Packard | 294/15 X |
| 2,472,500 | 6/1949 | Swanson | 294/92 |
| 2,602,634 | 7/1952 | Read | 294/19 R X |

*Primary Examiner*—Johnny D. Cherry

[57] ABSTRACT

A truss hoist having two U-shaped members and a swivel fastening device which swivelly fastens one leg of the first U-shaped member to a base of the second U-shaped member. Two legs and the base of the first U-shaped member accommodate a portion of a prefabricated structural member such as a prefabricated roof truss. Two legs of the second U-shaped member are rotatably mounted with a limited degree of movement on a rectangular member. The truss hoist is utilized by an individual to grip, raise, and support a roof truss or other structural member during construction of a building.

9 Claims, 5 Drawing Figures

FIG. 4
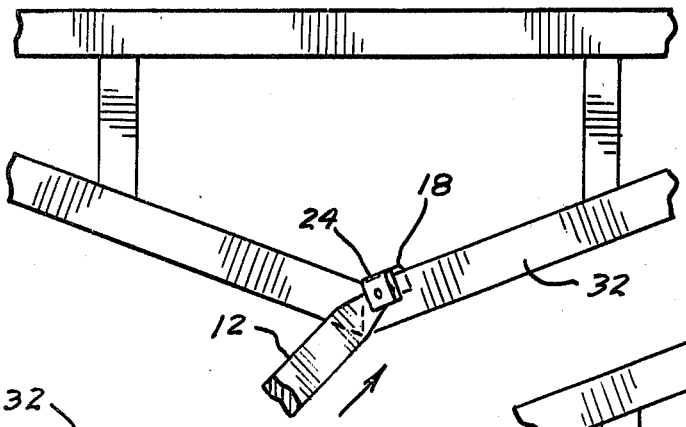
FIG. 5
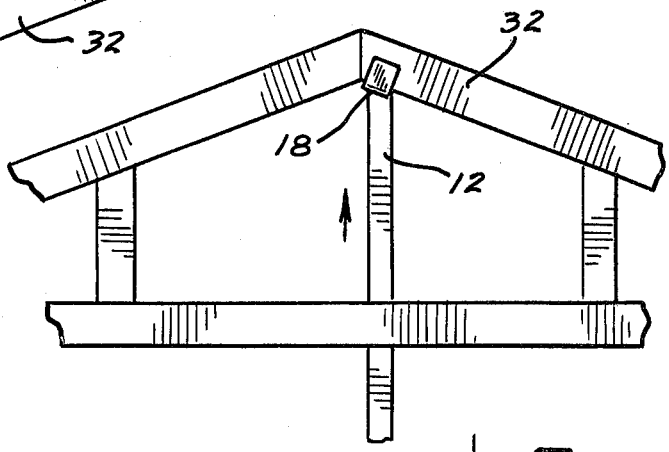
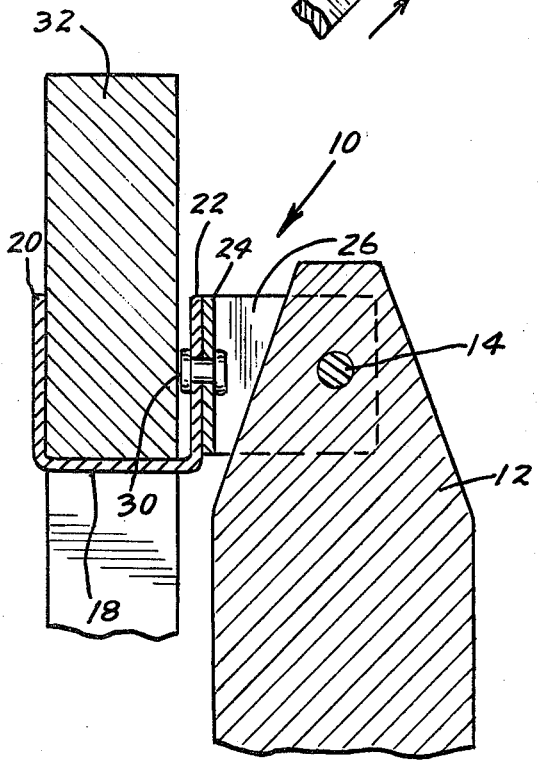
FIG. 3
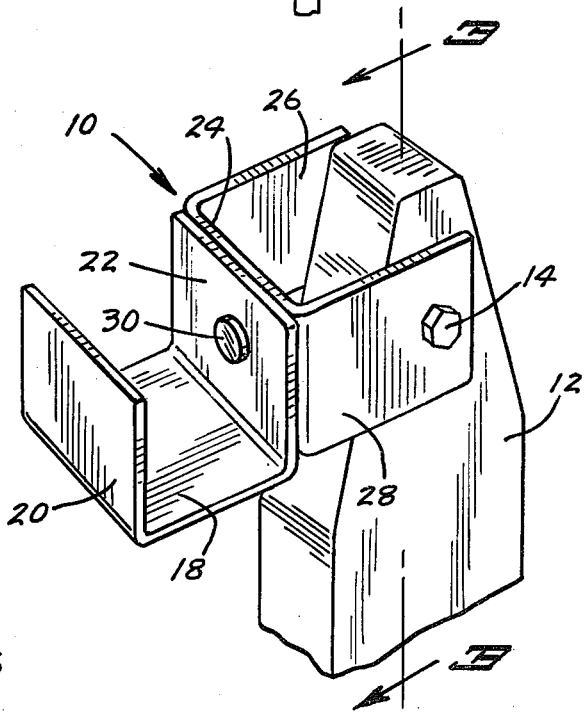
FIG. 1
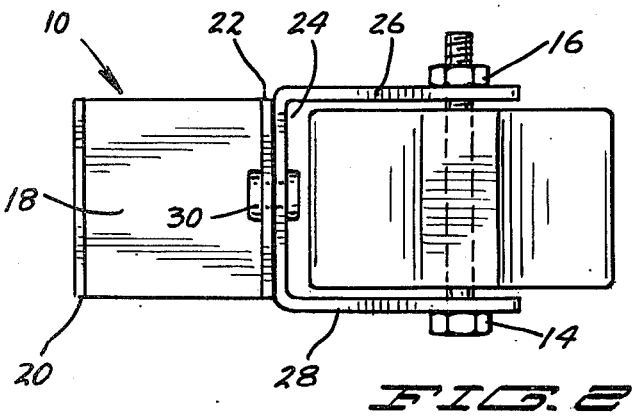
FIG. 2

TRUSS HOIST

BACKGROUND OF THE INVENTION

1. Field of the Invention

The present invention relates to a new truss hoist, and more particularly, pertains to a new truss hoist having two U-shaped members such that one U-shaped member is supported by a rectangular member and another U-shaped member swivelly held to the first U-shaped member accommodates a structural member for gripping, raising, and supporting of the structural member during construction.

2. Description of the Prior Art

One of the most critical problems confronting builders of new construction is the lifting and supporting of prefabricated structural members such as roof trusses during construction of new homes.

It has become a general practice in the construction industry that prefabricated roof trusses are manually lifted up by two or more individuals to rest on the framing of a building such as a home and then other individuals will nail the prefabricated roof truss into position. This construction practice has resulted in considerable expenditures of labor in addition to requiring a number of individuals to align and hold the prefabricated roof trusses on the top of the building during fastening.

This invention provides a truss hoist which minimizes the number of individuals in holding, raising, and supporting a truss during installation on a building.

SUMMARY OF THE INVENTION

The present invention obviates the foregoing disadvantages of the prior art by providing a truss hoist rotatably mounted on a rectangular member and capable of gripping, raising, and supporting a truss during installation on a building.

According to a preferred embodiment of the present invention, there is provided a truss hoist having a first U-shaped member, a second U-shaped member, a swivel fastening device holding one leg of the first U-shaped member to the base of the second U-shaped member, a rotating device securing the legs of the second U-shaped member to a rectangular member whereby the first U-shaped member accommodates a structural member to be gripped, raised, and positioned on a building and a rectangular member is held by an individual to hold, raise, and support the structural member.

Having briefly described an embodiment of the present invention, it is a principal object thereof to provide a new truss hoist.

An object of the present invention is to provide a truss hoist permitting one individual to grip, raise, and position a prefabricated structural member such as a roof truss during construction of a building.

Another object of the present invention is to provide a truss hoist which permits an individual to support and move a prefabricated structural member into position during construction of a building and hold the prefabricated structural member during fastening to the building.

DESCRIPTION OF THE DRAWING

Other objects and many of the attendant advantages of this invention will be readily appreciated as the same is better understood by reference to the following detailed description when considered in connection with the accompanying drawing, in which like reference numerals designate like parts throughout the Figures thereof and wherein:

FIG. 1 illustrates a perspective view of a preferred embodiment of the invention, a truss hoist;

FIG. 2 illustrates a top view of the invention;

FIG. 3 illustrates a section of the invention taken on line 3—3 of FIG. 1 looking in the direction of the arrows;

FIG. 4 illustrates the invention being placed onto a prefabricated structural member; and, FIG. 5 illustrates the invention supporting the prefabricated structural member.

DESCRIPTION OF A PREFERRED EMBODIMENT

FIG. 1, which illustrates a perspective view of the invention, shows a truss hoist 10, the invention, rotatably mounted with a limited degree of movement on a rectangular member 12 by a bolt 14 having a locking nut 16. The rectangular member 12, for way of example and purposes of illustration only, can be a 2×4 structural wood member but can also be any suitable rectangular member such as an aluminum rectangular member. The truss hoist 10 comprises a first U-shaped member 18 with two legs 20 and 22, a second U-shaped member 24 with two legs 26 and 28, and one leg 22 of the first U-shaped member 18 swivelly held to the base of the second U-shaped member 24 by a swivel fastener 30. The fastener 30, for way of example and purposes of illustration only, can be a rivet or other suitable swivel fastening device capable of rotatably holding the leg 22 of the first U-shaped member 18 to the base of the second U-shaped member 24. The bolt 14 rotatably mounts the two legs 26 and 28 of the second U-shaped member 24 to the rectangular member 12.

FIG. 2 which illustrates a top view of the truss hoist 10 shows the rectangular member 12, the bolt 14 with the locking nut 16, the first U-shaped member 18, the second U-shaped member 20, and the fastener 30 swivelly holding the one leg 22 of the U-shaped member 18 to the base of the second U-shaped member 24. The bolt 14 and the nut 16 rotatably mount the two legs 26 and 28 of the second U-shaped member to the rectangular member 12.

FIG. 3 which illustrates a section of the truss hoist 10 taken along the line 3—3 of FIG. 1 shows the rectangular member 12, the bolt 14, the first U-shaped member 18, the second U-shaped member 24, the fastener 30 swivelly holding the one leg 22 of the U-shaped member 18 to the base of the U-shaped member 24, and a prefabricated structural member 32 gripped by the two legs 20 and 22 of the first U-shaped member 18.

PREFERRED MODE OF OPERATION

FIGS. 4 and 5 illustrate a preferred mode of operation of the truss hoist 10 rotatably mounted with a limited degree of movement to the rectangular structure member 12 and gripping the prefabricated structural member 32 such as a prefabricated roof truss with the base and legs 20 and 22 of the first U-shaped member 18. The first U-shaped member 18 is placed around a portion of the prefabricated structural member 32 as shown in FIG. 4. An individual holding the rectangular support member 12 raises the prefabricated structural member 32 into position as shown in FIG. 5 with an upward movement of the rectangular support member 12 to vertically position the prefabricated structural member 32 such as a truss prior to being secured by nails or other suitable fastening devices to a structure such as the framing of a house.

For ease of construction and during the erection of prefabricated structural members 32 such as trusses, the truss hoist 10 U-shaped members can be made of heavy gauge aluminum or if more strength is required for larger trusses, of stainless steel and the fastening hardware of the bolt 14, the nut 16 and more importantly the swivel fastener 30 can be aluminum or stainless steel hardware. The rectangular structure support member can be any wood 2×4 free of knots or an aluminum rectangular member.

The truss hoist for ease of transportation and storage can be bolted onto a 2×4 at a construction site with the 2×4 subsequently being used in a construction of a building. This way, a builder can store and transport the truss hoist in his tool box.

Various modifications can be made to the truss hoist of the present invention without departing from the apparent scope of the invention.

Having thus described the invention, what is claimed is:

1. A truss hoist for use in gripping, raising and supporting a prefabricated structural member comprising:

a. a first U-shaped means for gripping, raising, and positioning a prefabricated structural member;

b. a second U-shaped means having means rotatably mounting said second U-shaped means to a rectangular support member; and, c. a swivel fastening means fastening one leg of said first U-shaped means to the base of said second U-shaped means whereby said first U-shaped means grips, raises, and positions said prefabricated structural member while said second U-shaped means is rotatably mounted to said rectangular member, and said rectangular member being held, raised and supported by an individual during construction of a building.

2. The truss hoist of claim 1 wherein said first U-shaped means accommodates a 2×4.

3. The truss hoist of claim 1 wherein said second U-shaped means accommodates a 2×4.

4. The truss hoist of claim 1 wherein said first U-shaped means and said second U-shaped means are made of heavy gauge aluminum.

5. The truss hoist of claim 1 wherein said first U-shaped means and said second U-shaped means comprise stainless steel.

6. The truss hoist of claim 1 wherein said swivel fastening means comprises a stainless steel rivet.

7. The truss hoist of claim 1 wherein said swivel fastening means comprises an aluminum rivet.

8. The truss hoist of claim 1 wherein said swivel fastening means comprises a stainless steel bolt and nut.

9. The truss hoist of claim 1 wherein said swivel fastening means comprises an aluminum bolt and nut.

* * * * *